United States Patent [19]

Hall

[11] 4,068,109

[45] Jan. 10, 1978

[54] MANUAL OPERATOR FOR A PUSHBUTTON CONTROL DEVICE

[75] Inventor: Donald S. B. Hall, Clarksville, Va.

[73] Assignee: Westinghouse Electric Corporation, Pittsburgh, Pa.

[21] Appl. No.: 702,256

[22] Filed: July 2, 1976

[51] Int. Cl.[2] ..... H01H 3/20

[52] U.S. Cl. ..... 200/332; 74/110; 200/322; 200/327; 200/335; 200/340

[58] Field of Search ..... 200/42 R, 50 R, 50 A, 200/329, 330, 322, 333, 334, 335, 327, 340, 332; 74/522.5, 565, 110

[56] References Cited

U.S. PATENT DOCUMENTS

| | | | |
|---|---|---|---|
| 1,801,228 | 4/1931 | Edhlund | 200/42 R |
| 2,370,877 | 3/1945 | Robbins | 200/50 A X |
| 2,460,599 | 2/1949 | Rowe | 200/335 X |
| 3,186,981 | 6/1965 | De Rowde | 200/322 X |
| 3,678,236 | 7/1972 | Hughos | 200/322 X |

*Primary Examiner*—Elliot A. Goldberg
*Attorney, Agent, or Firm*—R. W. Smith

[57] ABSTRACT

A manual operator for a pushbutton control device includes a cover having protected space surrounding an opening receiving the pushbutton. The cover further includes a raised stop surface adjacent the protected space. A lever actuator is pivotally mounted to the cover so as to concurrently overlie the pushbutton and the stop surface when in a nonoperating position. The actuator is moved into alignment with the protected space and is depressed to assume an operating position.

5 Claims, 4 Drawing Figures

MANUAL OPERATOR FOR A PUSHBUTTON CONTROL DEVICE

BACKGROUND OF THE INVENTION

This invention relates to a manual operator for a pushbutton control device and more particularly to such an operator including a cover mounted on the control device and an actuator that has nonoperating and operating positions for protecting the pushbutton and depressing the pushbutton.

Pushbutton control devices are commonly used in operator-controlled machines. These machines often require that the start and end of machine operations are only at definite predetermined times under manual control of the machine operator. The control devices are arranged so that the machine will operate only during the time that the pushbutton is depressed.

Prior art solutions include protective guards or shields for protecting a pushbutton and upon displacement of protective means the pushbutton is exposed for manual operation. For example, in U.S. Pat. No. 2,659,780 a safety appliance for switches is disclosed including a flat guard which is hinged at one side to normally overlie a starting pushbutton of a machine control switch. The free end of the guard is swung away from the control switch to expose the pushbutton for its operation. An inwardly directed projection of the guard prevents the guard from being pressed inwardly against the pushbutton. In U.S. Pat. No. 2,370,877 a sheet metal shield is pivotally mounted so that when it is held in a raised position it overlies a pushbutton. Operation of the pushbutton is prevented. When the free-swinging end is released, the shield drops to an exposed position so that the pushbutton may be manually operated. In both of the aforementioned patents, the guard or shield only protects the pushbutton and is not utilized to effect intended operation of the pushbutton.

In U.S. Pat. No. 1,801,228 a pushbutton station having both a start and a stop bushbutton includes a hinged plate which when swung away from the housing of the station permits manual operation of either pushbutton. When the plate is raised and swung inwardly to a protecting state, the plate overlies the start pushbutton to prevent its operation. Concurrently, an inwardly projecting log of the plate depresses and operates the stop pushbutton with the plate in the operating state. The start pushbutton can always be operated when the guard is left down and is in the inoperative state. Neither one of the start or stop pushbuttons is both protected nor operated by alternate positions of the guard.

Accordingly, it is desirable that a pushbutton control device be protected from accidental or unintentional operation. It is further desired that a machine associated with the control device be actuated only upon deliberate and intended action by the machine operator that causes the pushbutton to be depressed. These and other desired features of a manual pushbutton operator are provided in accordance with the present invention.

SUMMARY OF THE INVENTION

In accordance with the present invention, a manual operator for a pushbutton control device includes a cover mountable on the front face of the control device with the pushbutton extending through a hole in the cover. An actuator is pivotally mounted for arcuate movement between operating and nonoperating positions. The cover includes a protected space surrounding the pushbutton hole and further includes a raised stop surface adjacent the protected space. The actuator is shaped so as to be received into the protected space and to be depressed against the pushbutton when in the operating position. The actuator is further shaped to concurrently overlie the stop surface and the pushbutton when it is fully extended to prevent operation of the pushbutton.

In a preferred form of this invention, the cover includes an elongated recess having sidewalls defining the protected space surrounding the pushbutton hole. A raised stop surface extends substantially parallel to the bottom of the recess and slightly above the outer extended position of the pushbutton. An abutment surface extends outwardly from one side of the stop surface and to the top of the cover. The actuator is maintained over the pushbutton by the abutment surface and the stop surface prevents the actuator from being depressed against the pushbutton. The actuator operating position is vertically above the nonoperating position. Accordingly, upon release of the actuator it falls to the protected nonoperating position. These and other advantages and features will be apparent from the detailed description of the invention hereinbelow.

DETAILED DESCRIPTION OF THE PREFERRED EMBODIMENT

Figure 1:
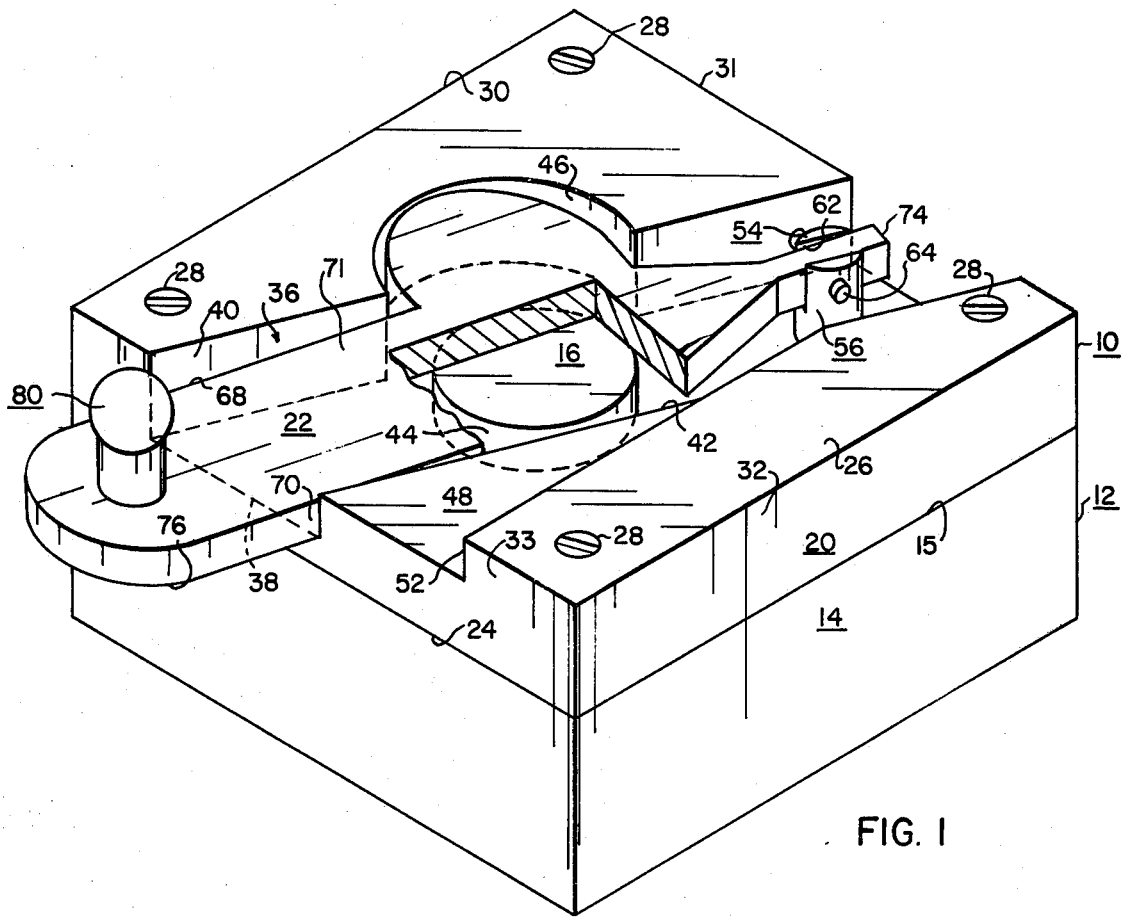
FIG. 1 is an isometric view of a manual operator for a pushbutton control device made in accordance with this invention and illustrating the operator in an operating condition.
Figure 2:
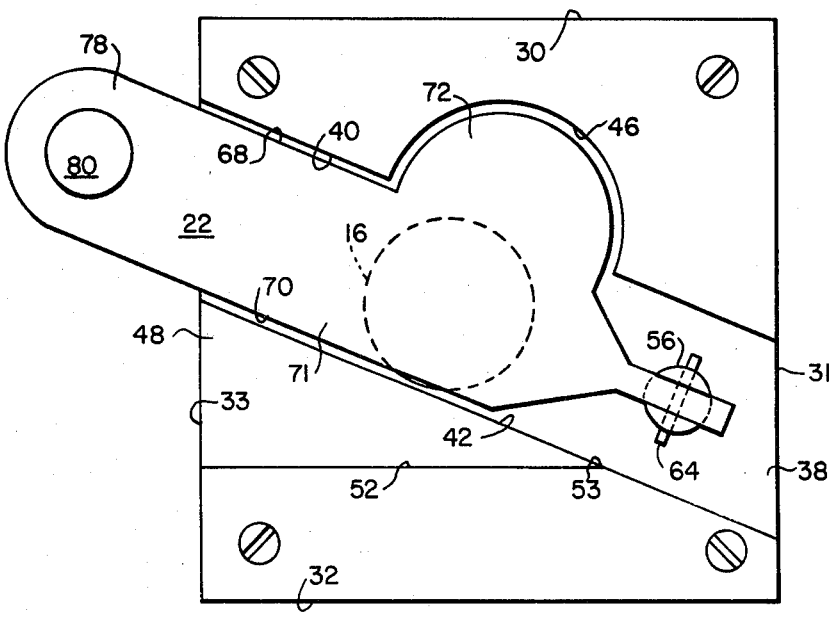
FIG. 2 is a front plan view of the manual operator for a pushbutton control device shown in FIG. 1.
Figure 4:
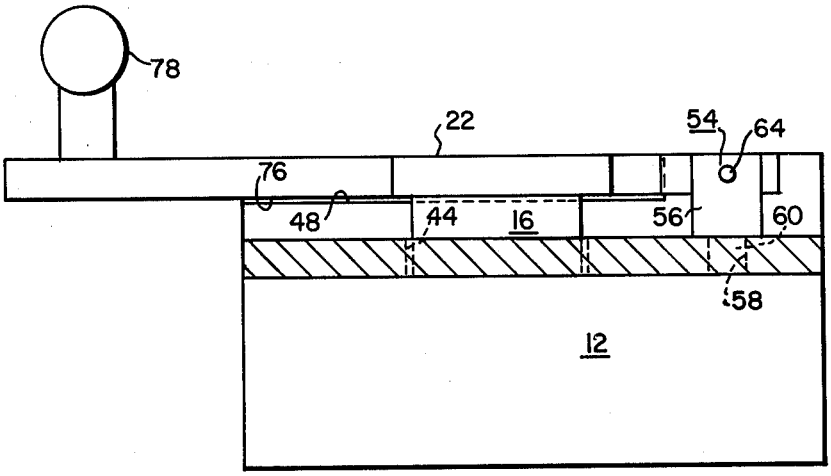
FIG. 4 is a cross-sectional view of FIG. 3 taken along the axis IV—IV and looking in the direction of the arrows.

Referring now to the drawing and more particularly to FIG. 1, there is illustrated an isometric view of a manual operator 10 made in accordance with this invention for a pushbutton control device 12. The control device 12 typically couples a source of energy, such as from a source of electricity or pneumatic or hydraulic pressures, to a machine to be controlled. A housing 14 of the control device 12 encloses a mechanism such as a switch or valve having an associated pushbutton 16 extending through the front face 15 of the housing 14. The pushbutton 16 is reciprocally movable inwardly and outwardly of the housing 14 and is biased outwardly by a spring or other suitable means, not shown. When the pushbutton is extended furthest from the front face 15, as shown in FIG. 4, the control device 12 disconnects or isolates the energy source from the machine to be controlled to thereby deactivate the machine or one of the machine's operations. Upon the pushbutton being depressed, as shown in FIGS. 1 and 2, the control device 10 activates a machine to be controlled by energizing it from an energy source. The machine will remain activated so long as the pushbutton 16 is depressed. Accordingly, the pushbutton 16 provides a starting or activating function for a controlled machine while depressed and a stopping or deactivating function of the controlled machine when it is released to the extended position.

Figure 3:
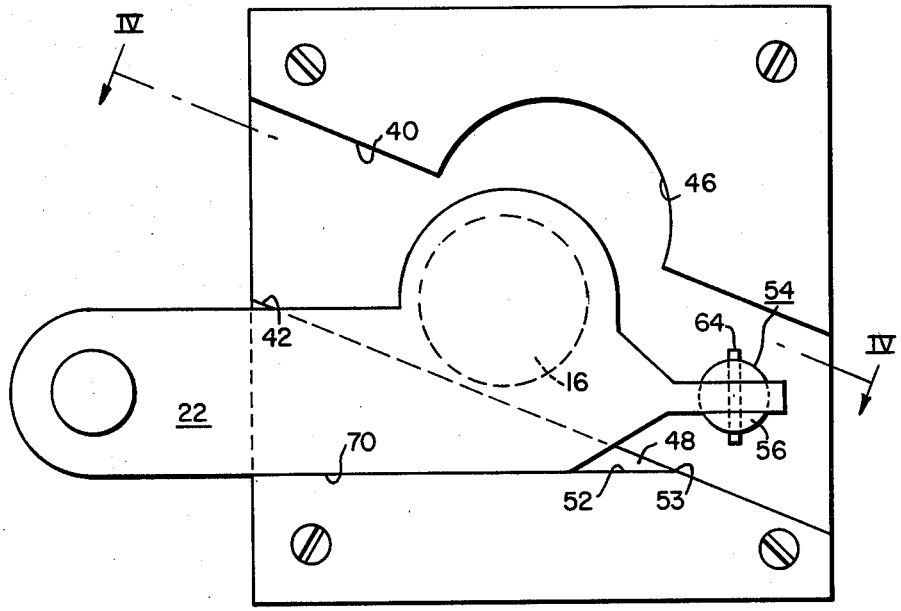
FIG. 3 is a front plan view corresponding to FIG. 2 illustrating a nonoperating condition of the manual operator.

In accordance with this invention, the manual operator 10 is operational between an operating condition shown in FIGS. 1 and 2 and a nonoperating condition shown in FIGS. 3 and 4. In the nonoperating condition, the pushbutton 16 is protected and prevented from being depressed. To assume the operating condition, the manual operator 10 must be intentionally and deliberately moved by hand-operating action. Upon release of the operating action, the manual operator 10 automatically assumes the protective nonoperating condition.

The operator 10 is illustrated in FIG. 1 as it includes a cover 20 and a lever actuator 22 shown in an operating position. The cover 20 includes a rear 24 and a front 26. The rear 24 is mounted against the front face 15 and screws 28 hold the cover 20 in place on the housing 14. The edges 30, 31, 32 and 33 of the cover form a generally rectangular outline to conform to the shape of the housing 14.

An elongated recess 36 of the cover 20 has a bottom 38 and opposite sidewalls 40 and 42. The bottom 38 extends in a plane substantially parallel to the rear 24 that includes a hole 44 shown in FIG. 4 extending between the bottom 38 and the rear 24 for receiving the pushbutton 16, as shown. The sidewalls 40 and 42 are generally parallel, except for a notched portion 46 for purposes described hereinbelow, and extend along the front 26 and through the opposite edges 31 and 33 at an angle to the outer edges 30 and 32. The sidewall 40 extends substantially perpendicular to the bottom 38 and to the outermost surface of the front 26. The sidewall 42 extends substantially perpendicular to the bottom 38 and to a stop surface 48. The predetermined height of the sidewall 42 is substantially equal or slightly more than the length of the portion of the pushbutton 16 extending from the bottom 38 when it is in a fully-extended inactive condition. Thus described, the portion of the recess 36 immediately surrounding the pushbutton hole 44, adjacent the notched portion 46, and extending between the sidewalls 40 and 42 through the edge 33 defines a protected space for freely admitting the actuator 22 to the operating position as shown in FIG. 1 and described further hereinbelow.

The stop surface 84 is outwardly intermediate the bottom 38 and the outermost surface of the front 26 and extends in a plane substantially parallel to the bottom 38. As viewed in FIG. 1, the stop surface 48 is terminated on the right-hand side by an abutment surface 52 extending to the outermost surface of the front side 26. The abutment surface 52 is substantially perpendicular to the stop surface 48 and is substantially parallel to the edge 32. The abutment surface 52 intersects the sidewall 42 at the corner 53 near the edge 31 to define a generally flat triangular shape to the stop surface 48.

A pivot mounting 54 includes a swivel 56 carried for rotation in a hole 58, shown in FIG. 4, extending through the bottom 38 substantially equidistant between the sidewalls 40 and 42. The short shaft forming the swivel 56 has a reduced diameter at the lower portion which is within the hole 58 so that the upper portion of the swivel 56 rests on the bottom 38. A fastener 60 holds the swivel 56 within the hole 58 for rotation therein. The swivel 56 is positioned between the pushbutton hole 44 and the edge 31. The outer end of the swivel 56 is bifurcated and includes a notch 62 for providing a trunnion-like mounting of the actuator 22. A pivot pin 64 extends diametrically across the stud 56 and through a part of the actuator 22 in the notch 62 as described hereinbelow.

The actuator 22, forming an important feature of this invention, includes a general outline complementary to the lateral cross-section of the protected space of the elongated recess 36 described above and receivable therein when it is in the operating position as shown in FIGS. 1 and 2. The actuator 22 is formed as an elongated lever having substantially straight parallel sides 68 and 70 defining the body 71 of the actuator which includes a laterally extending guard portion 72 extending from the left-hand side of the side 68. As seen in FIG. 2, the sidewall notch portion 46 is generally complementary-shaped to the guard portion 72. This allows the body 71 of the actuator to be positioned over the pushbutton 16 when the actuator is either in the operating position or nonoperating position. A first end 74 of the actuator 22 has a reduced width and a transverse hole through the narrowed end. This permits positioning of the end 74 within the notch 62 of the swivel 56 and pivotal attachment by the pivot pin 64 extending through the actuator hole and between the bifurcated portions of the swivel 56. The height of the pivotal attachment of the end 74 is such as to permit a clearance between the bottom 76 of the actuator and stop surface 48.

The second and outer end 78 of the actuator 22 includes a knob handle 80. The handle 80 is intended for grasping for manual movement of the actuator between the nonoperating position shown in FIGS. 3 and 4 and to the operating position shown in FIGS. 1 and 2. The mounting of the actuator 22 as thus described, provides lateral arcuate movement of the actuator about the axis of rotation of the swivel 56 in the hole 58. Also, inward and outward movement of the actuator is provided by the pivotal movement about the axis of the pivot pin 64.

Referring now to the operation of the manual operator 10, FIGS. 3 and 4 show the normal nonoperating position of the actuator 22. The horizontal position of the actuator in FIG. 3 is maintained by gravity forces causing the actuator side 70 to rest against the abutment surface 52. This positions the actuator body 71 and the guard portion 72 so that they overlie the normally extended pushbutton 16. As shown in FIG. 4, the stop surface 48 maintains the actuator 22 in a limiting inward position over the pushbutton 16 preventing any inward pressure on the actuator 22 from depressing the pushbutton 16. Any inward pressure against the actuator 22 causes the bottom surface 76 to be forced against the stop surface 48. Accordingly, activation of the controlled-machine by the pushbutton control device 12 is not possible.

It is to be kept in mind that the manual pushbutton operator 10 may be mounted so that it is positioned ninety arcuate degrees from the position shown in FIGS. 2 and 3 so that the edges 30 and 32 are vertical rather than horizontal. Gravity forces will still maintain the actuator 22 in a vertical position and maintain it so that the actuator overlies the pushbutton 16. Further movement toward the edge 32 would be prevented by the abutment surface 52.

When it is desired to produce a desired operation at the controlled-machine by operation of the control device 12, the knob 80 is grasped in the hand of an operator and swung upward. This swings the actuator 22 about the axis of rotation of the swivel 56 as it rotates in the bottom surface hole 60. Upon the body 71 and guard portion 72 of the actuator being positioned over the protected space of the recess 36, including the space formed by the notch 46 and the space of the bottom surface 38 between the swivel 56 and the edge 33, a second movement is required by depressing the actuator end 78. This presses the bottom surface 76 against the top of the pushbutton 16 and forces it into the housing of the pushbutton control device 12. The outward biasing force on the pushbutton 16 requires that the end 78 be held inwardly depressed for as long as the desired operation by the control device 12 is required. Pivotal movement of the actuator end 74 occurs about the pivot pin 64 to permit arcuate inwardly and outwardly movement of the actuator 22 relative to the bottom surface 38 and, therefore, the pushbutton 16. The inward movement causes the actuator side 68 and 70 to be juxtapositioned the recess sidewalls 40 and 42, respectively.

Any intentional or inadvertant action by a machine operator which results in release of the handle 80 and actuator end 78 permits the biased pushbutton 16 to move outwardly from the housing 14 to an inactive condition. This forces the actuator 22 to be pivoted outwardly and away from sidewall 42. Upon clearing the corner between the sidewall 42 and the stop surface 48, the actuator drops over the stop surface 48 until the actuator rests adjacent the abutment surface 52. If the manual pushbutton operator 10 is mounted with the edges 30 and 32 vertical, the actuator will assume a vertical position rather than a horizontal one shown in FIG. 2. In either orientation, the side 70 of the actuator will be adjacent the abutment surface 52 and the actuator bottom 76 will concurrently overlie the stop surface 48 and the pushbutton 16. Thus, the pushbutton 16 is protected until positive hand operating action returns the actuator 22 to the operating position shown in FIGS. 1 and 2.

While a preferred embodiment of this invention has been described hereinabove, it is contemplated that modification and changes thereto may be made without departing from the spirit and scope of this invention.

What is claimed is:

1. A control device including a reciprocally movable pushbutton extending through a front face thereof, said pushbutton normally having an extended deactivating position and being depressable to assume an activating position, said control device further including a manual operator for selectively engaging and depressing said pushbutton wherein said manual operator comprises:

a cover including a front and a rear, said rear being mounted over said front face of said control device, said front including a predetermined shaped bottom surface terminating at one side at a sidewall and defining a protected space thereabove and surrounding a hole through the cover rear receiving said pushbutton, said side wall extending to a predetermined height above the activating position of said pushbutton and terminating at a stop surface extending away from said pushbutton at said predetermined height adjacent said bottom surface; and an actuator having a shape complementary to said bottom surface so as to be receivable within said protected space surrounding said pushbutton, said actuator including first and second ends, said first end being rotationally and pivotally connected to said cover so that said second end has free-swinging lateral movement over said bottom surface and pivotal movement toward and away from said bottom surface when moving between arcuately displaced operating and nonoperating positions, said nonoperating position of said actuator concurrently extending over said stop surface and covering said protected space when said pushbutton is in the normally extended position, and said operating position of said actuator being laterally spaced from said stop surface and pivotally extending into said protected space in a depressing engaged relationship with said pushbutton to effect the activating position thereof, whereby said actuator covers said pushbutton in depressed engagement when in said operating position and further covers said pushbutton in a protecting relationship when in said nonoperating position.

2. The control device as claimed in claim 1 wherein said front of said cover includes an elongated recess formed by said bottom surface, said first named sidewall, and an opposite sidewall extending outwardly from said bottom surface a second predetermined height greater than the first named predetermined height.

3. The control device as claimed in claim 2 including a swivel member having one end rotatably mounted in said bottom surface and a second end pivotally connecting the first end of said actuator so as to provide both the lateral swinging and the inward and outward pivotal movements of said actuator relative to said bottom surface.

4. The control device as claimed in claim 3 wherein said stop surface is substantially flat and extends from said one sidewall to an abutment surface extending substantially perpendicular and outward of said stop surface so as to limit lateral movement of said actuator away from the nonoperating position.

5. The control device as claimed in claim 4 wherein said abutment surface extends outwardly of said stop surface along a substantially horizontal plane in a nonparallel relationship to said one sidewall so that said actuator rests on said abutment surface when said actuator is in said nonoperating position.

* * * * *